US006172591B1

(12) United States Patent
Barrett

(10) Patent No.: US 6,172,591 B1
(45) **Date of Patent: *Jan. 9, 2001**

(54) MULTILAYER CONDUCTIVE POLYMER DEVICE AND METHOD OF MANUFACTURING SAME

(75) Inventor: Andrew Brian Barrett, Douglas (IE)

(73) Assignee: Bourns, Inc., Riverside, CA (US)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 09/035,196

(22) Filed: Mar. 5, 1998

(51) Int. Cl.[7] ..... H01C 7/10; H01C 7/13

(52) U.S. Cl. ..... 338/22 R; 338/307; 338/309; 338/308

(58) Field of Search ..... 338/22 R, 21, 338/307, 309

(56) References Cited

U.S. PATENT DOCUMENTS

| | | | |
|---|---|---|---|
| H414 | 1/1988 | Newnham et al. | 338/22 R |
| 2,861,163 | 11/1958 | Asakawa . | |

(List continued on next page.)

FOREIGN PATENT DOCUMENTS

| | | | |
|---|---|---|---|
| 1088709 | 6/1994 | (CN) | H01C/7/02 |
| 2838508 | 3/1980 | (DE) . | |
| 0158410 | 7/1984 | (EP) . | |
| 1167551 | 10/1969 | (GB) . | |
| 62-240526 | 10/1987 | (JP) . | |
| WO97/06660 | 2/1997 | (WO) . | |
| 98/12715 | 3/1998 | (WO) . | |

OTHER PUBLICATIONS

Arrowsmith, D. J. (1970) "Adhesion of Electroformed Copper and Nickel to Plastic Laminates," *Transactions of the Institute of Metal Finishing*, vol. 48, pp. 88–92. (No month).

*Primary Examiner*—Lincoln Donovan
*Assistant Examiner*—Kyung S. Lee
(74) *Attorney, Agent, or Firm*—Klein & Szekeres, LLP

(57) ABSTRACT

A conductive polymer device has three or more conductive polymer layers sandwiched between two external electrodes and two or more internal electrodes. The electrodes are staggered to create a first set of electrodes, in contact with a first terminal, alternating with a second set of electrodes in contact with a second terminal. A device having three polymer layers is manufactured by: (1) providing (a) a first laminated substructure comprising a first polymer layer between first and second metal layers, (b) a second polymer layer, and (c) a second laminated substructure comprising a third polymer layer between third and fourth metal layers; (2) forming first and second internal arrays of isolated metal areas in the second and third metal layers, respectively; (3) laminating the first and second substructures to opposite surfaces of the second polymer layer to form a laminated structure; (4) forming first and second external arrays of isolated metal areas in the first and fourth metal layers, respectively; (5) forming a plurality of first terminals, each electrically connecting one of the metal areas in the first external array to one of the metal areas in the second internal array, and a plurality of second terminals, each electrically connecting one of the metal areas in the second external array to one of the metal areas in the first internal array; and (6) singulating the laminated structure into a plurality of devices, each having three polymer layers connected in parallel between a first terminal and a second terminal.

6 Claims, 6 Drawing Sheets

U.S. PATENT DOCUMENTS 2,978,665 4/1961 Vernet et al. ..... 338/223
3,061,501 10/1962 Dittman et al. .
3,138,686 6/1964 Mitoff et al. .
3,187,164 6/1965 Andrich .
3,243,753 3/1966 Kohler ..... 338/31
3,535,494 10/1970 Armbruster .
3,619,560 11/1971 Buiting et al. .
3,689,736 9/1972 Meyer .
3,823,217 7/1974 Kampe .
3,824,328 7/1974 Ting et al. .
3,878,501 4/1975 Moorhead et al. ..... 338/22 R
4,101,862 7/1978 Takagi et al. ..... 338/23
4,151,401 4/1979 Van Bokestal et al. .
4,177,376 12/1979 Horsma et al. .
4,177,446 12/1979 Diaz ..... 338/212
4,237,441 12/1980 van Konynenburg et al. .... 338/22 R
4,238,812 12/1980 Middleman et al. .
4,246,468 1/1981 Horsma .
4,250,398 2/1981 Ellis et al. .
4,272,471 6/1981 Walker .
4,314,230 2/1982 Cardinal et al. ..... 338/314
4,314,231 2/1982 Walty ..... 338/328
4,315,237 2/1982 Middleman et al. ..... 338/22 R
4,317,027 2/1982 Middleman et al. .
4,327,351 4/1982 Walker ..... 338/22 R
4,329,726 5/1982 Middleman et al. .
4,341,949 7/1982 Steiner et al. .
4,352,083 9/1982 Middleman et al. ..... 338/23
4,413,301 11/1983 Middleman et al. .
4,426,633 1/1984 Taylor ..... 338/25
4,445,026 4/1984 Walker .
4,481,498 11/1984 McTavish et al. ..... 338/20
4,542,365 9/1985 McTavish et al. ..... 338/20
4,545,926 10/1985 Foutz, Jr. et al. .
4,639,818 1/1987 Cherian .
4,647,894 3/1987 Ratell ..... 338/22 R
4,647,896 3/1987 Ratell ..... 338/22 R
4,654,511 3/1987 Horsma et al. .
4,685,025 8/1987 Carlomagno .
4,689,475 8/1987 Kleiner et al. .
4,698,614 10/1987 Welch et al. ..... 338/22 R
4,706,060 11/1987 May ..... 338/20
4,732,701 3/1988 Nishii et al. .
4,752,762 6/1988 Inano et al. ..... 338/22 R
4,766,409 8/1988 Mandai ..... 338/22 R
4,769,901 9/1988 Nagahori .
4,774,024 9/1988 Deep et al. .
4,787,135 11/1988 Nagahori .
4,800,253 1/1989 Kleiner et al. .
4,811,164 3/1989 Ling et al. ..... 361/321
4,829,553 * 5/1989 Shindo et al. ..... 338/309
4,849,133 7/1989 Yoshida et al. .
4,876,439 10/1989 Nagahori .
4,882,466 11/1989 Friel .
4,884,163 11/1989 Deep et al. .
4,904,850 2/1990 Claypool et al. .
4,907,340 3/1990 Fang et al. .
4,924,074 5/1990 Fang et al. .
4,937,551 6/1990 Plasko ..... 338/22 R
4,951,382 8/1990 Jacobs et al. .
4,951,384 8/1990 Jacobs et al. .
4,954,696 9/1990 Ishii et al. .
4,955,267 9/1990 Jacobs et al. .
4,967,176 10/1990 Horsma et al. ..... 338/22 R
4,980,541 12/1990 Shafe et al. .
4,983,944 1/1991 Uchida et al. ..... 338/22 R
5,015,824 5/1991 Monter et al. .
5,039,844 8/1991 Nagahori .
5,049,850 9/1991 Evans ..... 338/22 R
5,057,674 10/1991 Smith-Johannsen .
5,064,997 11/1991 Fang et al. .
5,089,688 2/1992 Fang et al. .
5,089,801 2/1992 Chan et al. ..... 338/22 R
5,140,297 8/1992 Jacobs et al. ..... 338/22 R
5,142,267 8/1992 Fellner et al. ..... 338/23
5,148,005 9/1992 Fang et al. .
5,164,133 11/1992 Ishida et al. .
5,166,658 11/1992 Fang et al. ..... 338/23
5,171,774 12/1992 Ueno et al. .
5,174,924 12/1992 Yamada et al. .
5,178,797 1/1993 Evans .
5,181,006 1/1993 Shafe et al. ..... 338/22 R
5,190,697 3/1993 Okita et al. .
5,195,013 3/1993 Jacobs et al. .
5,210,517 * 5/1993 Abe ..... 338/22
5,212,466 5/1993 Yamada et al. ..... 338/22 R
5,227,946 7/1993 Jacobs et al. .
5,241,741 9/1993 Sugaya .
5,247,277 9/1993 Fang et al. ..... 338/22 R
5,250,228 10/1993 Baigrie et al. .
5,280,263 1/1994 Sugaya ..... 338/22 R
5,303,115 4/1994 Nayar et al. .
5,351,390 10/1994 Yamada et al. .
5,358,793 10/1994 Hanada et al. ..... 428/560
5,699,607 12/1997 McGuire .
5,777,541 * 7/1998 Vekeman ..... 338/22 R
5,802,709 9/1998 Hogge et al. .
5,812,048 9/1998 Ross, Jr. et al. ..... 338/128
5,831,510 11/1998 Zhang et al. ..... 338/22 R
5,852,397 12/1998 Chan et al. ..... 338/22 R
5,864,281 1/1999 Zhang et al. ..... 338/22 R
6,020,808 * 2/2000 Hogge ..... 338/22 R

* cited by examiner

FIG. 15A
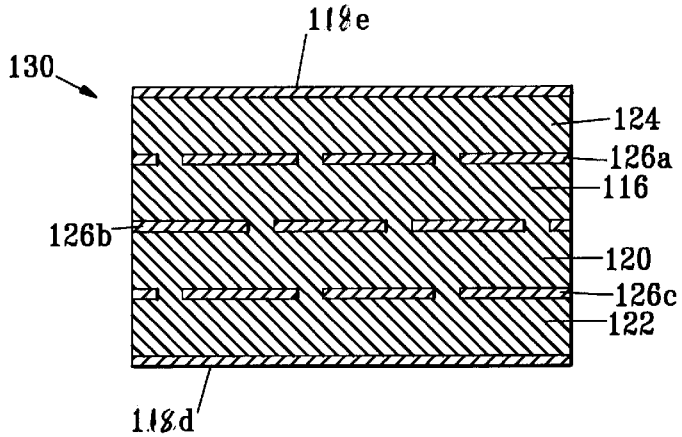
FIG. 17
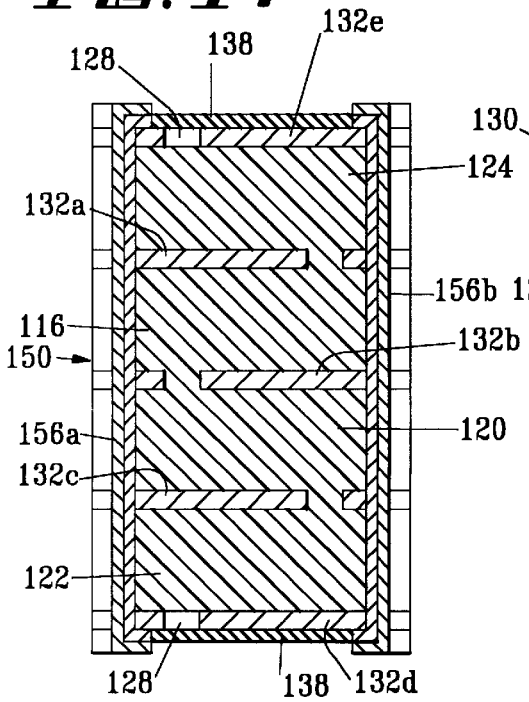
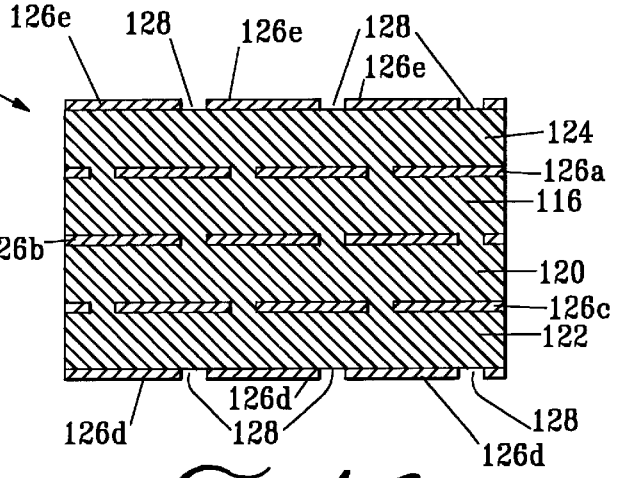
FIG. 16

MULTILAYER CONDUCTIVE POLYMER DEVICE AND METHOD OF MANUFACTURING SAME

FEDERALLY SPONSORED RESEARCH OR DEVELOPMENT

Not Applicable

CROSS-REFERENCE TO RELATED APPLICATIONS

Not Applicable

BACKGROUND OF THE INVENTION

The present invention relates generally to the field of conductive polymer positive temperature coefficient (PTC) devices. More specifically, it relates to conductive polymer PTC devices that are of laminar construction, with more than a single layer of conductive polymer PTC material, and that are especially configured for surface-mount installations.

Electronic devices that include an element made from a conductive polymer have become increasingly popular, being used in a variety of applications. They have achieved widespread usage, for example, in overcurrent protection and self-regulating heater applications, in which a polymeric material having a positive temperature coefficient of resistance is employed. Examples of positive temperature coefficient (PTC) polymeric materials, and of devices incorporating such materials, are disclosed in the following U.S. Pat. Nos.:

3,823,217—Kampe
4,237,441—van Konynenburg
4,238,812—Middleman et al.
4,317,027—Middleman et al.
4,329,726—Middleman et al.
4,413,301—Middleman et al.
4,426,633—Taylor
4,445,026—Walker
4,481,498—McTavish et al.
4,545,926—Fouts, Jr. et al.
4,639,818—Cherian
4,647,894—Ratell
4,647,896—Ratell
4,685,025—Carlomagno
4,774,024—Deep et al.
4,689,475—Klieiner et al.
4,732,701—Nishii et al.
4,769,901—Nagahori
4,787,135—Nagahori
4,800,253—Kleiner et al.
4,849,133—Yoshida et al.
4,876,439—Nagahori
4,884,163—Deep et al.
4,907,340—Fang et al.
4,951,382—Jacobs et al.
4,951,384—Jacobs et al.
4,955,267—Jacobs et al.
4,980,541—Shafe et al.
5,049,850—Evans
5,140,297—Jacobs et al.
5,171,774—Ueno et al.
5,174,924—Yamada et al.
5,178,797—Evans
5,181,006—Shafe et al.
5,190,697—Ohkita et al.
5,195,013—Jacobs et al.
5,227,946—Jacobs et al.

5,241,741—Sugaya
5,250,228—Baigrie et al.
5,280,263—Sugaya
5,358,793—Hanada et al.

One common type of construction for conductive polymer PTC devices is that which may be described as a laminated structure. Laminated conductive polymer PTC devices typically comprise a single layer of conductive polymer material sandwiched between a pair of metallic electrodes, the latter preferably being a highly-conductive, thin metal foil. See, for example, U.S. Pat. Nos. 4,426,633—Taylor; 5,089,801—Chan et al.; 4,937,551—Plasko; and 4,787,135—Nagahori; and International Publication No. WO97/06660.

A relatively recent development in this technology is the multilayer laminated device, in which two or more layers of conductive polymer material are separated by alternating metallic electrode layers (typically metal foil), with the outermost layers likewise being metal electrodes. The result is a device comprising two or more parallel-connected conductive polymer PTC devices in a single package. The advantages of this multilayer construction are reduced surface area ("footprint") taken by the device on a circuit board, and a higher current-carrying capacity, as compared with single layer devices.

In meeting a demand for higher component density on circuit boards, the trend in the industry has been toward increasing use of surface mount components as a space-saving measure. Surface mount conductive polymer PTC devices heretofore available have been generally limited to hold currents below about 2.5 amps for packages with a board footprint that generally measures about 9.5 mm by about 6.7 mm. Recently, devices with a footprint of about 4.7 mm by about 3.4 mm, with a hold current of about 1.1 amps, have become available. Still, this footprint is considered relatively large by current surface mount technology (SMT) standards.

The major limiting factors in the design of very small SMT conductive polymer PTC devices are the limited surface area and the lower limits on the resistivity that can be achieved by loading the polymer material with a conductive filler (typically carbon black). The fabrication of useful devices with a volume resistivity of less than about 0.2 ohm-cm has not been practical. First, there are difficulties inherent in the fabrication process when dealing with such low volume resistivities. Second, devices with such a low volume resistivity do not exhibit a large PTC effect, and thus are not very useful as circuit protection devices.

The steady state heat transfer equation for a conductive polymer PTC device may be given as:

$$0=[I^2R(f(T_d))]-[U(T_d-T_a)], \quad (1)$$

where I is the steady state current passing through the device; $R(f(T_d))$ is the resistance of the device, as a function of its temperature and its characteristic "resistance/temperature function" or "R/T curve"; U is the effective heat transfer coefficient of the device; $T_d$ is temperature of the device; and $T_a$ is the ambient temperature.

The "hold current" for such a device may be defined as the value of I necessary to trip the device from a low resistance state to a high resistance state. For a given device, where U is fixed, the only way to increase the hold current is to reduce the value of R.

The governing equation for the resistance of any resistive device can be stated as $$R=\rho L/A, \quad (2)$$

where ρ is the volume resistivity of the resistive material in ohm-cm, L is the current flow path length through the device in cm, and A is the effective cross-sectional area of the current path in $cm^2$.

Thus, the value of R can be reduced either by reducing the volume resistivity ρ, or by increasing the cross-sectional area A of the device.

The value of the volume resistivity ρ can be decreased by increasing the proportion of the conductive filler loaded into the polymer. The practical limitations of doing this, however, are noted above.

A more practical approach to reducing the resistance value R is to increase the cross-sectional area A of the device. Besides being relatively easy to implement (from both a process standpoint and from the standpoint of producing a device with useful PTC characteristics), this method has an additional benefit: In general, as the area of the device increases, the value of the heat transfer coefficient also increases, thereby further increasing the value of the hold current.

In SMT applications, however, it is necessary to minimize the effective surface area or footprint of the device. This puts a severe constraint on the effective cross-sectional area of the PTC element in device. Thus, for a device of any given footprint, there is an inherent limitation in the maximum hold current value that can be achieved. Viewed another way, decreasing the footprint can be practically achieved only by reducing the hold current value.

There has thus been a long-felt, but as yet unmet, need for very small footprint SMT conductive polymer PTC devices that achieve relatively high hold currents.

SUMMARY OF THE INVENTION

Broadly, the present invention is a conductive polymer PTC device that has a relatively high hold current while maintaining a very small circuit board footprint. This result is achieved by a multilayer construction that provides an increased effective cross-sectional area A of the current flow path for a given circuit board footprint. In effect, the multilayer construction of the invention provides, in a single, small-footprint surface mount package, three or more PTC devices electrically connected in parallel.

In one aspect, the present invention is a conductive polymer PTC device comprising, in a preferred embodiment, multiple alternating layers of metal foil and PTC conductive polymer material, with electrically conductive interconnections to form three or more conductive polymer PTC devices connected to each other in parallel, and with termination elements configured for surface mount termination.

Specifically, two of the metal layers form, respectively, first and second external electrodes, while the remaining metal layers form a plurality of internal electrodes that physically separate and electrically connect three or more conductive polymer layers located between the external electrodes. First and second terminals are formed so as to be in physical contact with all of the conductive polymer layers. The electrodes are staggered to create two sets of alternating electrodes: a first set that is in electrical contact with the first terminal, and a second set that is in electrical contact with the second terminal. One of the terminals serves as an input terminal, and the other serves as an output terminal.

A first specific embodiment of the invention comprises first, second, and third conductive polymer PTC layers. A first external electrode is in electrical contact with a first terminal and with an exterior surface of the first conductive polymer layer that is opposed to the surface facing the second conductive polymer layer. A second external electrode is in electrical contact with a second terminal and with an exterior surface of the third conductive polymer layer that is opposed to the surface facing the second conductive polymer layer. The first and second conductive polymer layers are separated by a first internal electrode that is in electrical contact with the second terminal, while the second and third conductive polymer layers are separated by a second internal electrode that is in electrical contact with the second terminal. In such an embodiment, if the first terminal is an input terminal and the second terminal is an output terminal, the current flow path is from the first terminal to the first external electrode and to the second internal electrode. From the first external electrode, current flows through the first conductive polymer layer to the first internal electrode and then to the second terminal. From the second internal electrode, current flows through the second conductive polymer layer to the first internal electrode and then to the second terminal, and through the third conductive polymer layer to the second external electrode and then to the second terminal. Thus, the resulting device is, effectively, three PTC devices connected in parallel. This construction provides the advantages of a significantly increased effective cross-sectional area for the current flow path, as compared with a single layer device, without increasing the footprint. Thus, for a given footprint, a larger hold current can be achieved.

A second specific embodiment of the invention comprises first, second, third, and fourth conductive polymer PTC layers. The first and fourth conductive polymer layers are separated by a first internal electrode that is in electrical contact with a first terminal; the first and second conductive polymer layers are separated by a second internal electrode that is in electrical contact with a second terminal; and the second and third conductive polymer layers are separated by a third internal electrode that is in electrical contact with the first terminal. A first external electrode is in electrical contact with the second terminal and with an exterior surface of the third conductive polymer layer that is opposed to the surface facing the second conductive polymer layer. A second external electrode is in electrical contact with the second terminal and with an exterior surface of the fourth conductive polymer layer that is opposed to the surface facing the first conductive polymer layer.

In another aspect, the present invention is a method of fabricating the above-described devices. For a device having three conductive polymer PTC layers, this method comprises the steps of: (1) providing (a) a first laminated substructure comprising a first conductive polymer PTC layer sandwiched between first and second metal layers, (b) a second conductive polymer PTC layer, and (c) a second laminated substructure comprising a third conductive polymer PTC layer sandwiched between third and fourth metal layers; (2) isolating selected areas of the second and third metal layers to form, respectively, first and second internal arrays of internal electrodes; (3) laminating the first and second laminated substructures to opposite surfaces of the second conductive polymer PTC layer to form a laminated structure comprising the first conductive polymer layer sandwiched between the first and second metal layers, the second conductive polymer PTC layer sandwiched between the second and third metal layers, and the third conductive polymer PTC layer sandwiched between the third and fourth metal layers; (4) isolating selected areas of the first and fourth metal layers to form, respectively, first and second external arrays of isolated metal areas; and (5) forming a plurality of first terminals, each electrically connecting one of the isolated metal areas in the first external array to one of the isolated metal areas in the second internal array, and a plurality of second terminals, each electrically connecting one of the isolated metal areas in the first internal array to one of the isolated metal areas in the second external array.

For a device having four conductive polymer PTC layers, a similar fabrication method is employed, except that a third laminated substructure, comprising a fifth metal layer laminated to a fourth conductive polymer PTC layer, is provided in the first step; selected areas of the first, second, and third metal layers are isolated in the second step to form, respectively, first, second, and third internal arrays of isolated metal areas; the fourth conductive polymer PTC layer is laminated to the first metal layer in the third step to form a laminated structure comprising the first conductive polymer PTC layer sandwiched between the first and second metal layers, the second conductive polymer PTC layer sandwiched between the second and third metal areas, the third conductive polymer PTC layer sandwiched between the third and fourth metal layers, and the fourth conductive polymer layer sandwiched between the first and fifth metal layers; selected areas of the fourth and fifth metal layers are isolated in the fourth step to form the first and second external arrays of isolated metal areas; and, in the fifth step, the pluralities of first and second terminals are formed such that each of the first terminals electrically connects one of the isolated metal areas in the first internal array to one of the isolated metal areas in the third internal array, and such that each of the second terminals electrically connects one of the isolated metal areas in the first external array to one of the isolated metal areas in the second external array and to one of the isolated metal areas in the second internal array.

More specifically, the step of forming the arrays of isolated metal areas includes the step of isolating, by etching, selected areas of the metal layers to form the first and second internal arrays of isolated metal areas and the first and second external arrays of isolated metal areas (and the third internal array of isolated metal areas in the four conductive polymer PTC layer embodiment). The steps of forming the first and second terminals comprise the steps of (a) forming vias at spaced intervals in the laminated structure, each of the vias intersecting one of the isolated metal areas in each of the first and second external arrays and each of the first and second internal arrays; (b) plating the peripheral surfaces of the vias and adjacent surface portions of the isolated metal areas in the first and second external arrays with a conductive metal plating; and (c) overlaying a solder plating over the metal-plated surfaces.

The final step of the fabrication process comprises the step of singulating the laminated structure into a plurality of individual conductive polymer PTC devices, each of which has the structure described above. Specifically, the isolated metal areas in the first and second external arrays are formed, by the singulation step, respectively into first and second pluralities of external electrodes, while the isolated metal areas in the first and second (and third) internal arrays are thereby respectively formed into first and second (and third) pluralities of internal electrodes.

The above-mentioned advantages of the present invention, as well as others, will be more readily appreciated from the detailed description that follows.

BRIEF DESCRIPTION OF THE DRAWINGS

FIG. 15A is a cross-sectional view, similar to that of FIG. 15, but showing the laminated structure formed after the lamination of the substructures and the internal conductive polymer PTC layer of FIG. 14;

FIG. 16 is a cross-sectional view of the laminated structure, similar to FIG. 15, after the performance of the step of creating first and second external arrays of isolated metal areas respectively in the fourth and fifth metal layers shown in FIG. 1; and FIG. 17 is a cross-sectional view of a singulated conductive polymer PTC device in accordance with a second preferred embodiment of the present invention.

DETAILED DESCRIPTION OF THE INVENTION

Figure 1:
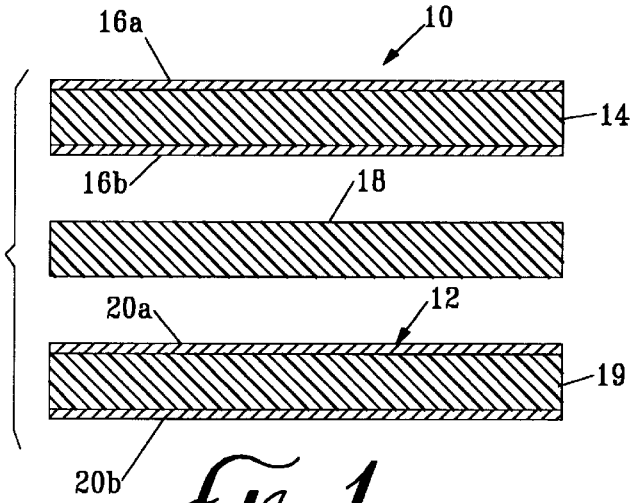
FIG. 1 is a cross-sectional view of the laminated substructures and a middle conductive polymer PTC layer, illustrating the first step of a conductive polymer PTC device fabrication method in accordance with a first preferred embodiment of the present invention.

Referring now to the drawings, FIG. 1 illustrates a first laminated substructure or web 10, and a second laminated substructure or web 12. The first and second webs 10, 12 are provided as the initial step in the process of fabricating a conductive polymer PTC device in accordance with the present invention. The first laminated web 10 comprises a first layer 14 of conductive polymer PTC material sandwiched between first and second metal layers 16*a*, 16*b*. A second or middle layer 18 of conductive polymer PTC material is provided for lamination between the first web 10 and the second web 12 in a subsequent step in the process, as will be described below. The second web 12 comprises a third layer 19 of conductive polymer PTC material sandwiched between third and fourth metal layers 20*a*, 20*b*. The conductive polymer PTC layers 14, 18, 19 may be made of any suitable conductive polymer PTC composition, such as, for example, high density polyethylene (HDPE) into which is mixed an amount of carbon black that results in the desired electrical operating characteristics. See, for example, International Publication No. WO97/06660, assigned to the assignee of the present invention, the disclosure of which is incorporated herein by reference.

The metal layers 16*a*, 16*b*, 20*a*, and 20*b* may be made of copper or nickel foil, with nickel being preferred for the second and third (internal) metal layers 16*b*, 20*a*. If the metal layers 16*a*, 16*b*, 20*a*, 20*b* are made of copper foil, those foil surfaces that contact the conductive polymer layers are coated with a nickel flash coating (not shown) to prevent unwanted chemical reactions between the polymer and the copper. These polymer contacting surfaces are also preferably "nodularized", by well-known techniques, to provide a roughened surface that provides good adhesion between the metal and the polymer. Thus, in the illustrated embodiment, the second and third (internal) metal layers 16*b*, 20*a* are nodularized both surfaces, while the first and fourth (external) metal layers 16*a*, 20*b* are nodularized only on the single surface that contacts an adjacent conductive polymer layer.

The laminated webs 10, 12 may themselves be formed by any of several suitable processes that are known in the art, as exemplified by U.S. Pat. Nos. 4,426,633—Taylor; 5,089,801—Chan et al.; 4,937,551—Plasko; and 4,787,135—Nagahori; and International Publication No. WO97/06660.

Figure 2:
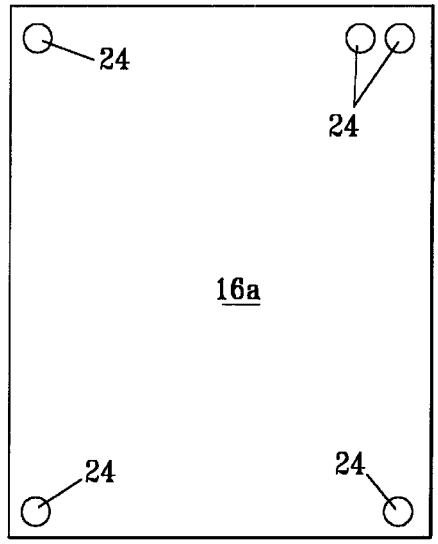
FIG. 2 is a top plan view of the first (upper) laminated substructure of FIG. 1.

It is advantageous at this point to provide some means for maintaining the webs 10, 12 and the middle conductive polymer PTC polymer layer 18 in the proper relative orientation or registration for carrying out the subsequent steps in the fabrication process. Preferably, this is done by forming (e.g., by punching or drilling) a plurality of registration holes 24 in the corners of the webs 10, 12 and the middle polymer layer 18, as shown in FIG. 2. Other registration techniques, well known in the art, may also be used.

Figure 3:
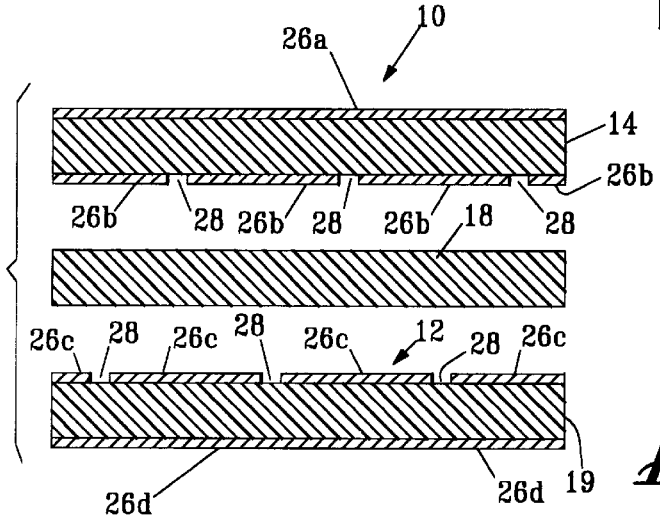
FIG. 3 is a cross-sectional view, similar to that of FIG. 1, after the performance of the step of creating first and second internal arrays of isolated metal areas respectively in the second and third metal layers of the laminated substructures of FIG. 1.

The next step in the process is illustrated in FIG. 3. In this step, a pattern of metal in each of the second and third (internal) metal layers 16*b*, 20*a* is removed to form first and second internal arrays of isolated metal areas 26*b*, 26*c*, respectively, in the metal layers 16*b*, 20*a*. Each of the isolated metal areas 26*b*, 26*c* in each of the internal metal layers 16*b*, 20*a* is electrically isolated from the adjacent metal areas in the same layer by the removal of a strip of metal. The metal removal is accomplished by means of standard techniques used in the fabrication of printed circuit boards, such as those techniques employing photoresist and etching methods. The removal of the metal results in an isolation gap 28 between adjacent metal areas in each of the metal layers.

Figure 3A:
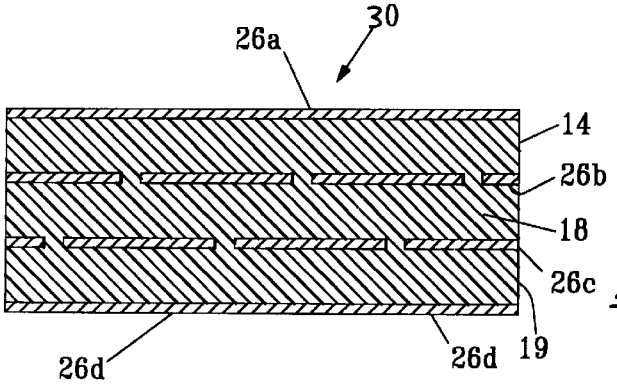
FIG. 3A is a cross-sectional view, similar to that of FIG. 3, but showing the laminated structure formed after the lamination of the substructures and the middle conductive polymer PTC layer of FIG. 1.

Ensuring that the webs 10, 12 and the middle conductive polymer PTC layer 18 are in proper registration, the middle conductive polymer PTC layer 18 is laminated between the webs 10, 12 by a suitable laminating method, as is well known in the art. The lamination may be performed, for example, under suitable pressure and at a temperature above the melting point of the conductive polymer material, whereby the material of the conductive polymer layers 14, 18, and 19 flows into and fills the isolation gaps 28. The laminate is then cooled to below the melting point of the polymer while maintaining pressure. The result is a laminated structure 30, as shown in FIG. 3A. At this point, the polymeric material in the laminated structure 30 may be cross-linked, by well-known methods, if desired for the particular application in which the device will be employed.

Figure 4:
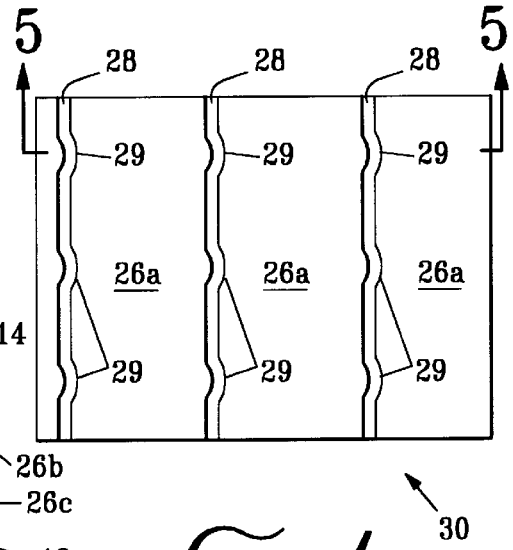
FIG. 4 is a top plan view of a portion of the laminated structure of FIG. 3A, after the performance of the step of creating first and second external arrays of isolated metal areas respectively in the first and fourth metal layers shown in FIG. 1.
Figure 5:
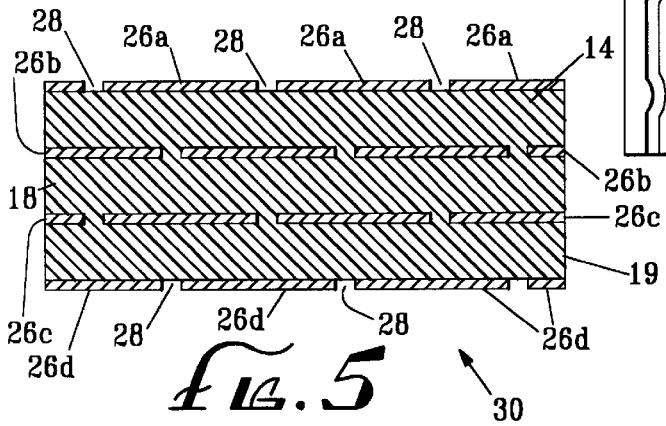
FIG. 5 is a cross-sectional view, taken along line 5—5 of FIG. 4.

After the laminated structure 30 has been formed, isolation gaps 28 are formed in the first metal layer 16*a* and the fourth metal layer 20*b* (the "external" metal layers), as shown in FIGS. 4 and 5. The formation of the isolation gaps 28 in the external metal layers 16*a*, 20*b* creates, respectively, first and second external arrays of isolated metal areas 26*a*, 26*d*. The isolation gaps 28 are staggered in alternating metal layers, so that each of the isolation gaps 28 in the second metal layer 16*b* overlies one of the isolated metal areas 26*c* in the third metal layer 20*a* and underlies one of the isolated metal areas 26*a* in the first metal layer 16*a*. In other words, the metal areas 26*a* in the first external array are in substantial vertical alignment with the metal areas 26*c* in the second internal array, and the metal areas 26*b* in the first internal array are in substantial vertical alignment with metal areas 26*d* in the second external array.

The shape, size, and pattern of the isolation gaps 28 will be dictated by the need to optimize the electrical isolation between the metal areas. In the illustrated embodiment, the isolation gaps 28 are in the form of narrow parallel bands, each with a plurality of arcs 29 at regular intervals. The purpose of the arcs 29 will be explained below.

Figure 6:
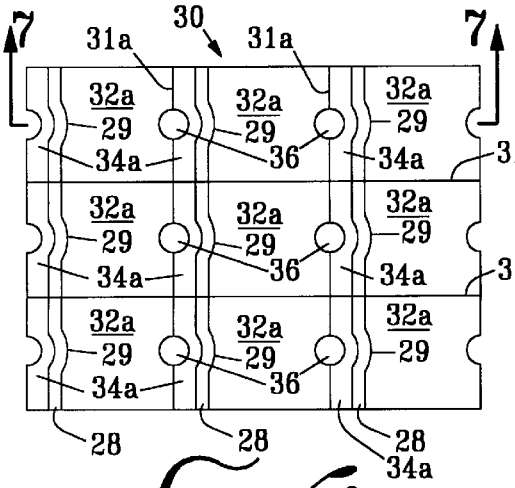
FIG. 6 is a top plan view of a portion of the laminated structure of FIG. 5, after the performance of the step of forming a plurality of vias.

FIGS. 6 through 9 illustrate the next few steps in the fabrication process, which are performed with the laminated structure 30 properly oriented by means of the registration holes 24. First, as shown in FIG. 6, a grid of score lines 31*a*, 31*b* may be formed, by conventional means, across at least one of the major surfaces of the structure 30. A first set of score lines 31*a* comprises a parallel array of score lines that are generally parallel to the isolation gaps 28, and that are spaced at uniform intervals, each adjacent to one of the isolation gaps 28. A second set of score lines 31*b* comprises a parallel array of score lines that perpendicularly intersect the first set 31*a* at regularly-spaced intervals. The score lines 31*a*, 31*b* divide each of the isolated metal areas 26*a*, 26*b*, 26*c*, 26*d* into a plurality of major areas 32*a*, 32*b*, 32*c*, 32*d*, respectively, and minor areas 34*a*, 34*b*, 34*c*, and 34*d*. Each of the major areas 32*a*, 32*b*, 32*c*, 32*d* is separated from an adjacent minor area 34*a*, 34*b*, 34*c*, 34*d* by one of the first set of score lines 31*a*. As will be seen, the major areas 32*a*, 32*b*, 32*c*, 32*d* will serve, respectively, as first, second, third, and fourth electrode elements in an individual device, and thus the latter terminology will hereinafter be employed.

Figure 7:
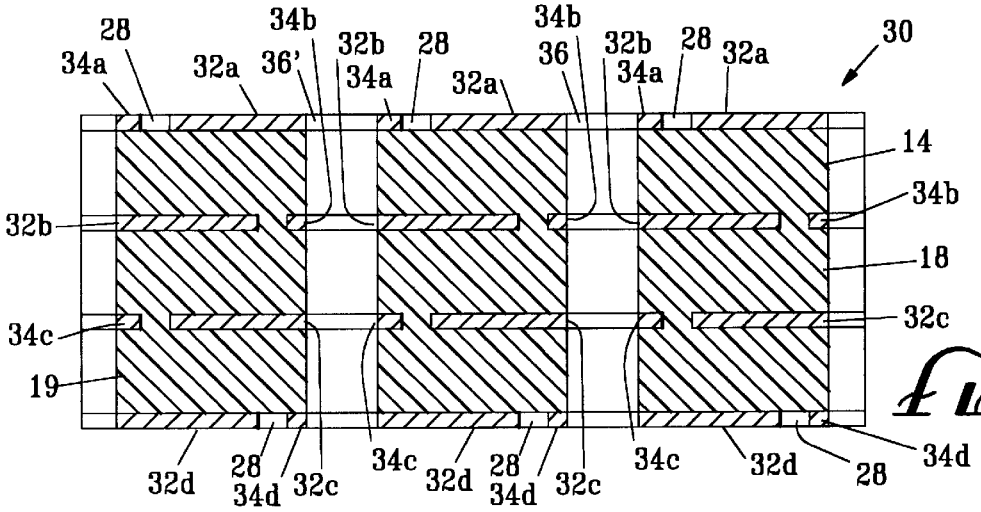
FIG. 7 is a cross-sectional view taken along line 7—7 of FIG. 6.

As shown in FIGS. 6 and 7, a plurality of through-holes or "vias" 36 are punched or drilled through the laminated structure 30 at regularly-spaced intervals along each of the first set of score lines 31*a*, preferably approximately mid way between each adjacent pair of the second set of score lines 31*b*. Because the isolation gaps 28 in the successive metal layers 16*a*, 16*b*, 20*a*, 20*b* are staggered, as described above, the major and minor areas of the metal areas 26*a*, 26*b*, 26*c*, and 26*d* are also staggered relative to each other, as best shown in FIG. 7. Thus, going from the top of the structure 30 downward (as oriented in the drawing), the isolation gaps 28 in successive metal layers are adjacent opposite sides of each of the vias 36, and alternating major and minor metal areas of successive metal layers are adjacent each of the vias 36. Specifically, referring to FIG. 7, and taking one of the vias 36' as a reference point, the first major area 32*a*, the second minor area 34*b*, the third major area 32*c*, and the fourth minor area 34*d* are adjacent the via 36', going from the top of the structure 30 downward.

Figure 8:
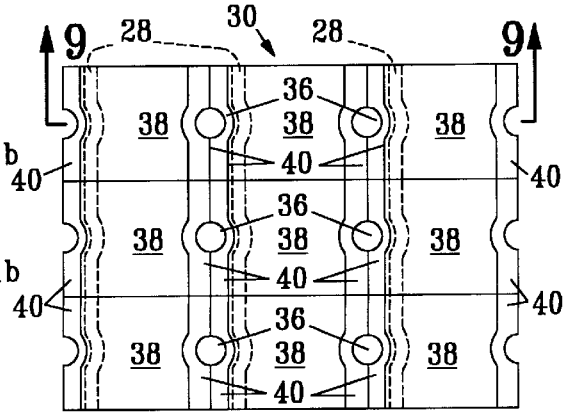
FIG. 8 is a top plan view, similar to that of FIG. 7, after the performance of the step of forming insulative isolation areas on the external metal areas.
Figure 9:
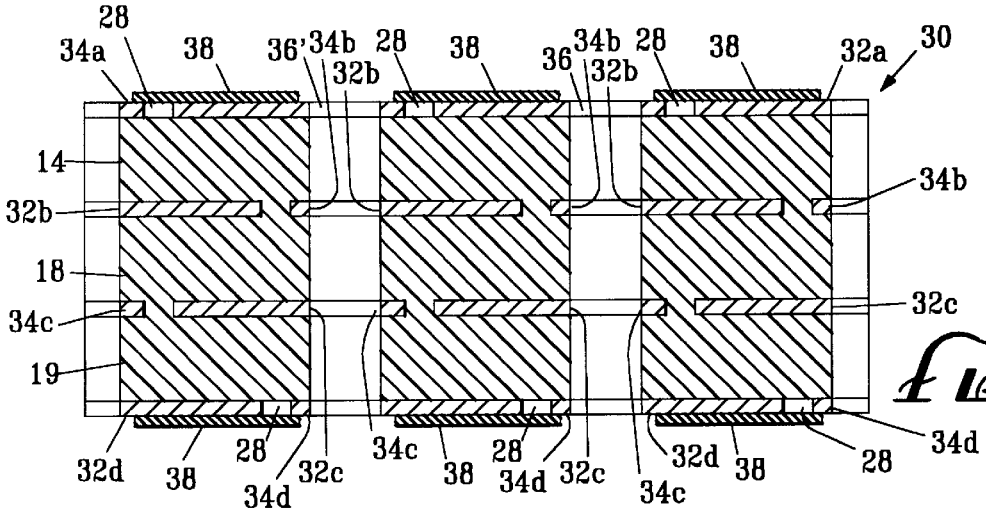
FIG. 9 is a cross-sectional view taken along line 9—9 of FIG. 8.

As shown in FIGS. 8 and 9, a thin isolating layer 38 of electrically insulating material, such as a glass-filled epoxy resin, is formed (as by screen printing) on each of the external major surfaces (i.e., the top and bottom surfaces, as viewed in the drawings). The isolating layers 38 are applied so as to cover the isolation gaps 28 and all but narrow peripheral edges of the electrode elements 32*a*, 32*d* and the minor metal areas 34*a*, 34*d*. The resulting pattern of the isolating layers 38 leaves a strip of exposed metal 40 along either side of each of the first set of score lines 31*a* on the top and bottom major surfaces of the structure 30. The arcs 29 in the isolation gaps 28 define a "bulge" around each of the vias 36, so that each via 36 is completely surrounded by exposed metal, as best shown in FIG. 8. The isolating layers 38 are then cured by the application of heat, as is well known in the art.

The specific order of the three major fabrication steps described above in connection with FIGS. 6 through 9 may be varied, if desired. For example, the isolation layers 38 may be applied either before or after the vias 36 are formed, and the scoring step may be performed as the first, second or third of these steps.

Figure 10:
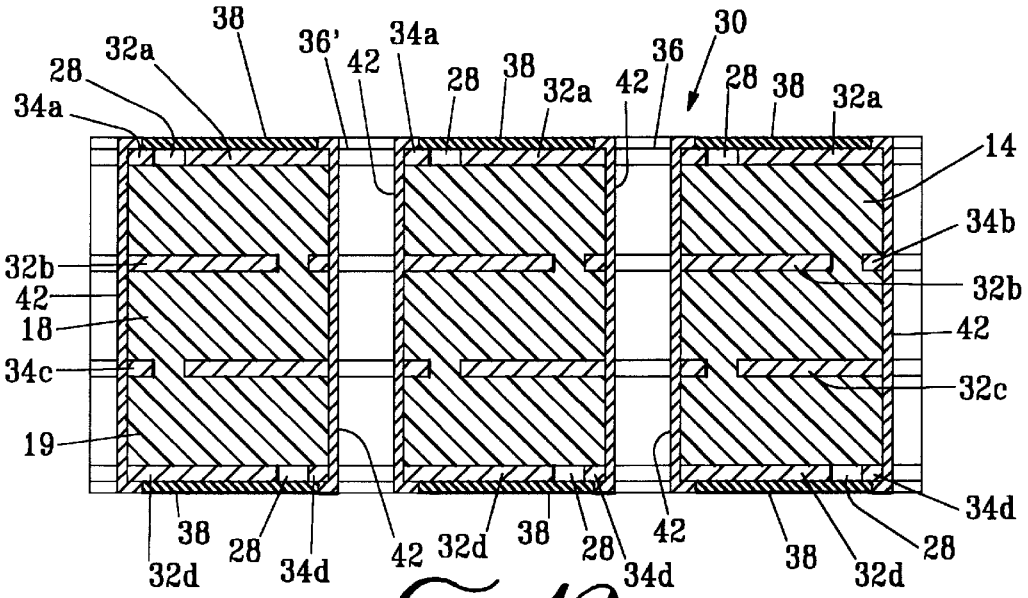
FIG. 10 is a cross-sectional view, similar to that of FIG. 9, after the performance of the step of metal-plating the vias and adjacent surface portions of the external metal areas.
Figure 11:
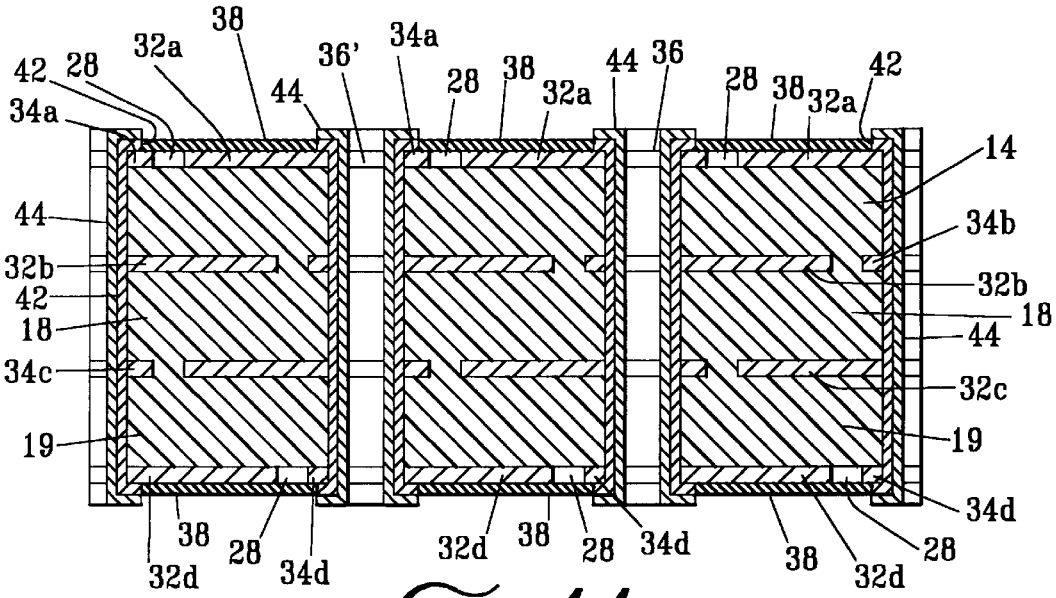
FIG. 11 is a cross-sectional view, similar to that of FIG. 10, after the performance of the step of plating the metal-plated surfaces with solder.

Next, as shown in FIG. 10, all exposed metal surfaces (i.e., the bare strips 40) and the internal surfaces of the vias 36 are coated with a plating 42 of conductive metal, such as tin, nickel, or copper, with copper being preferred. This metal plating step can be performed by any suitable process, such as electrodeposition, for example. Then, as shown in FIG. 11, the areas that were metal-plated in the previous step are again plated with a thin solder coating 44. The solder coating 44 can be applied by any suitable process that is well-known in the art, such as reflow soldering or vacuum deposition.

Figure 12:
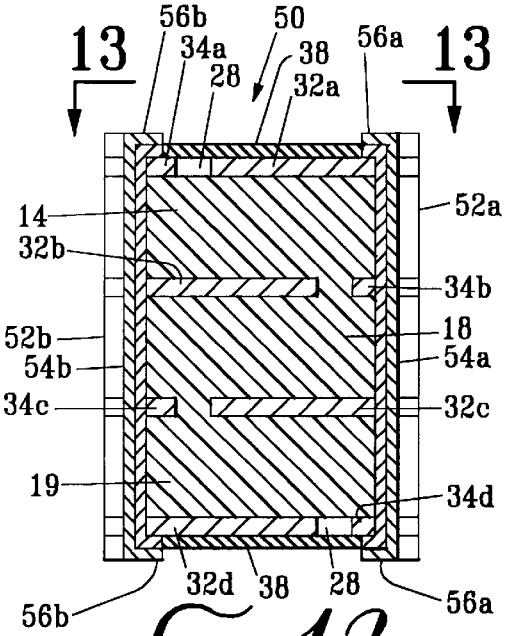
FIG. 12 is a cross-sectional view of a singulated conductive polymer PTC device in accordance with a first preferred embodiment of the present invention.
Figure 13:
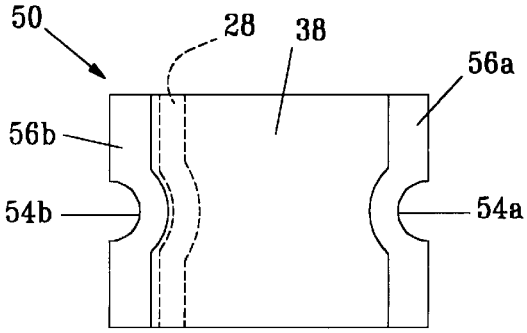
FIG. 13 is a top plan view of FIG. 12, taken along line 13—13 of FIG. 12.

Finally, the structure 30 is singulated (by well-known techniques) along the score lines 31*a*, 31*b* to form a plurality of individual conductive polymer PTC devices, one of which is shown in FIGS. 12 and 13 and is designated by the numeral 50. Because each of the first set of score lines 31*a* passes through a succession of vias 36 in the laminated structure 30, as shown in FIG. 6, each of the devices 50 formed after singulation has a pair of opposed sides 52*a*, 52*b*, each of which includes one-half of a via 36. The metal plating and the solder plating of the vias 36, described above, create first and second conductive vertical columns 54*a*, 54*b* in the half vias on the sides 52*a*, 52*b*, respectively. As can be seen in FIG. 12, the first conductive column 54*a* is in intimate physical contact with one of the external electrode elements (i.e., the first or top electrode element 32*a*) and one of the internal electrode elements (i.e., the third electrode element 32*c*). The second conductive column 54*b* is in intimate physical contact with the other external electrode element (i.e., the fourth or bottom electrode element 32*d*) and the other internal electrode element (i.e., the second electrode element 32*b*). The first conductive column 54*a* is also in contact with the second and fourth minor metal areas 34*b*, 34*d*, while the second conductive column 54*b* is also in contact with the first and third minor metal areas 34*a*, 34*c*. The minor metal areas 34*a*, 34*b*, 34*c*, 34*d* are of such small area as to have a negligible current-carrying capacity, and thus do not function as electrodes, as will be seen below.

Each device 50 also includes first and second pairs of metal-plated and solder-plated conductive strips 56*a*, 56*b* along opposite edges of its top and bottom surfaces. The first and second pairs of conductive strips 56*a*, 56*b* are respectively contiguous with the first and second conductive columns 54*a*, 54*b*. The first pair of conductive strips 56*a* and the first conductive column 54*a* form a first terminal, and the second pair of conductive strips 56*b* and the second conductive column 54*b* form a second terminal. The first terminal provides electrical contact with the first electrode element 32*a* and the third electrode element 32*c*, while the second terminal provides electrical contact with the second electrode element 32*b* and the fourth electrode element 32*d*. For the purposes of this description, the first terminal may be considered an input terminal and the second terminal may be considered an output terminal, but these assigned roles are arbitrary, and the opposite arrangement may be employed.

In the device 50 shown in FIGS. 12 and 13, the current path is as follows: From the input terminal (54*a*, 56*a*), current flows (a) through the first electrode element 32*a*, the first conductive polymer PTC layer 14, and the second electrode element 32*b* to the output terminal (54*b*, 56*b*); (b) through the third electrode element 32*c*, the third conductive polymer PTC layer 19, and the fourth electrode element 32*d*, to the output terminal; and (c) through the third electrode element 32*c*, the second (middle) conductive polymer PTC layer 18 and the second electrode element 32*b* to the output terminal. This current flow path is equivalent to connecting the conductive polymer PTC layers 14, 18, and 19 in parallel between the input and output terminals.

It will be readily apparent that the fabrication method described above may be easily adapted to the manufacture of a device having any number of conductive polymer PTC layers greater than three. FIGS. 14 through 17 illustrate specifically how the fabrication method of the present invention may be modified to manufacture a device having four conductive polymer PTC layers. For illustrative purposes only, the first few steps in the manufacture of a four layer device will be described.

Figure 14:
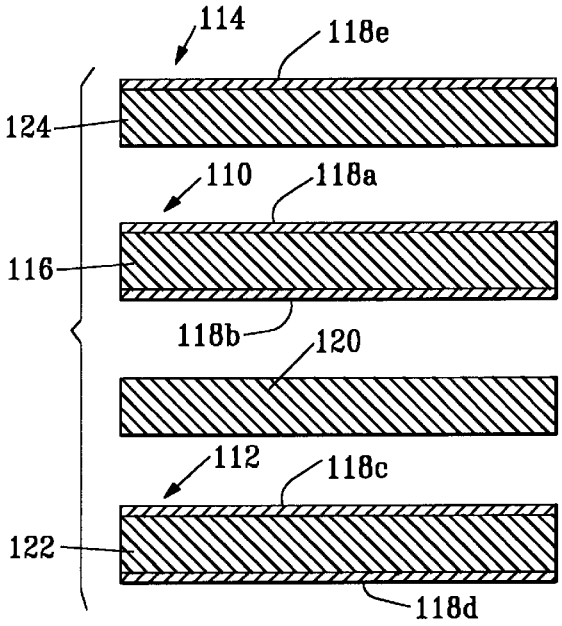
FIG. 14 is a cross-sectional view of the laminated substructures and an unlaminated internal conductive polymer PTC layer, illustrating the first step of a conductive polymer PTC device fabrication method in accordance with a second preferred embodiment of the present invention.

FIG. 14 illustrates a first laminated substructure or web 110, a second laminated substructure or web 112, and a third laminated substructure or web 114. The first, second, and third webs 110, 112, 114 are provided as the initial step in the process of fabricating a conductive polymer PTC device in accordance with the present invention. The first laminated web 110 comprises a first layer 116 of conductive polymer PTC material sandwiched between first and second metal layers 118*a*, 118*b*. A second conductive polymer PTC layer 120 is provided for placement between the first web 110 and the second web 112. The second laminated web 112 comprises a third conductive polymer PTC layer 122 sandwiched between third and fourth metal layers 118*c*, 118*d*. The third web 114 comprises a fourth layer 124 of conductive polymer PTC material with a fifth metal layer 118*e* laminated to its upper surface (as oriented in the drawings). The metal layers 118*a*–118*e* are made of nickel foil (preferred for the internal layers 118*a*, 118*b*, 118*c*) or copper foil with a nickel flash coating, and those surfaces of the metal layers that are to come into contact with a conductive polymer layer are preferably nodularized, as mentioned above.

Figure 15:
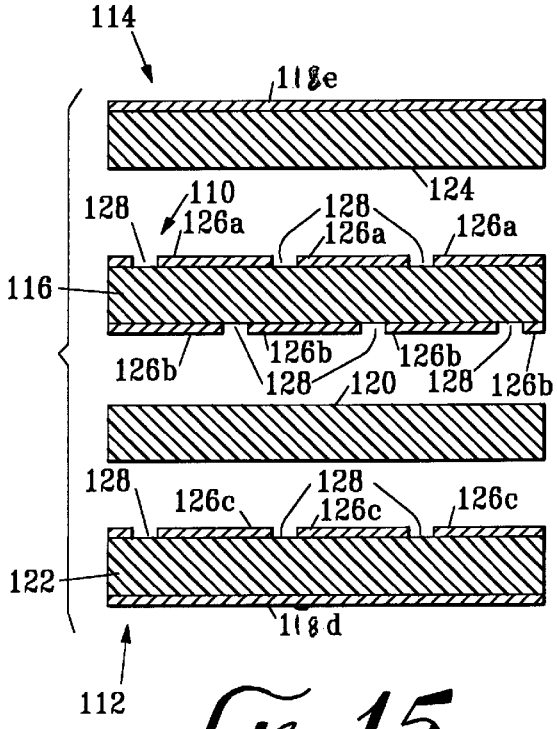
FIG. 15 is a cross-sectional view, similar to that of FIG. 14, after the performance of the step of creating first, second and third internal arrays of isolated metal areas respectively in first, second, and third metal layers of the laminated substructures of FIG. 14.

The webs 110, 112, 114 are shown in FIG. 15 after the step of removing strips of metal in a predetermined pattern in each of the internal metal layers 118*a*, 118*b*, 118*c* to create first, second, and third internal arrays of isolated metal areas 126*a*, 126*b*, 126*c* in the metal layers 118*a*, 118*b*, 118*c*, respectively. This step is performed in the manner described above. After this step, the isolated metal areas in each of the internal metal layers are separated by isolation gaps 128.

Ensuring that the webs 110, 112, 114, and the second conductive polymer PTC layer 120 are in proper registration, these webs and the second conductive polymer PTC layer 120 are laminated together to form a laminated structure 130, as shown in FIG. 15A. The lamination may be performed, for example, under suitable pressure and at a temperature above the melting point of the conductive polymer material, whereby the material of the conductive polymer layers 116, 120, 122, and 124 flows into and fills the isolation gaps 128. The laminate is then cooled to below the melting point of the polymer while maintaining pressure. The result is the laminated structure 130 shown in FIG. 15A. At this point, the polymeric material in the laminated structure 30 may be cross-linked, by well-known methods, if desired for the particular application in which the device will be employed.

After the laminated structure 130 has been formed, isolation gaps 128 are formed in the fifth metal layer 118*e* and the fourth metal layer 118*d* (the "external" metal layers), as shown in FIG. 16. The formation of the isolation gaps 128 in the external metal layers 118*d*, 118*e* creates, respectively, first and second external arrays of isolated metal areas 126*d*, 126*e*. The isolation gaps 128 are staggered in alternating metal layers, as described above with respect to the embodiment of FIGS. 1 through 13. In other words, the metal areas 126*d* in the first external array are in substantial vertical alignment with the metal areas 126*b* in the second internal array and with the metal areas 126*e* in the second external array, while the metal areas 126*a* in the first internal array are in substantial vertical alignment with metal areas 126*c* in the third internal array.

Thereafter, the fabrication process proceeds as describe above with reference to FIGS. 7–11. The result is a device 150 (FIG. 17) that is similar to that shown in FIGS. 12 and 13, except that there are four conductive polymer PTC layers separated by three internal electrode elements. The resulting device 150 is electrically equivalent to four conductive polymer PTC elements connected in parallel between an input terminal an output terminal.

Specifically, the device 150 comprises first, second, third, and fourth conductive polymer PTC layers 116, 120, 122, 124 respectively. The first and fourth conductive polymer PTC layers 116, 124 are separated by a first internal electrode 132*a* that is in electrical contact with a first terminal 156*a*; the first and second conductive polymer PTC layers 116, 120 are separated by a second internal electrode 132*b* that is in electrical contact with a second terminal 156*b*; and the second and third conductive polymer PTC layers 120, 122 are separated by a third internal electrode 132*c* that is in electrical contact with the first terminal 156*a*. A first external electrode 132*d* is in electrical contact with the second terminal 156*b* and with an exterior surface of the third conductive polymer PTC layer 122 that is opposed to the surface facing the second conductive polymer PTC layer 120. A second external electrode 132*e* is in electrical contact with the second terminal 156*b* and with an exterior surface of the fourth conductive polymer PTC layer 124 that is opposed to the surface facing the first conductive polymer layer 116. Insulative isolation layers 138, formed as described above with reference to FIG. 9, cover the portions of the external electrodes 132*d*, 132*e* between the electrodes 156*a*, 156*b*. The terminals 156*a*, 156*b* are formed by the metal plating and solder plating steps described above with reference to FIGS. 10 and 11.

If the first terminal 156*a* is arbitrarily chosen as an input terminal, and the second terminal 156 is arbitrarily chosen as the output terminal, the current path through the device 150 is as follows: From the input terminal, current enters the first and third internal electrode elements 132*a*, 132*c*. From the first internal electrode element 132*a*, current flows (a) through the fourth conductive polymer layer 124 and the second external electrode element 132*e* to the output terminal; and (b) through the first conductive polymer PTC layer 116 and the second internal electrode element 132*b* to the output terminal. From the third internal electrode element 132*c*, current flows (a) through the second conductive polymer PTC layer 120 and the second internal electrode element 132*b* to the output terminal; and (b) through the third conductive polymer PTC layer 122 and the first external electrode element 132*d* to the output terminal.

It will be appreciated that the device constructed in accordance with the above described fabrication process is very compact, with a small footprint, and yet it can achieve relatively high hold currents.

While exemplary embodiments have been described in detail in this specification and in the drawings, it will be appreciated that a number of modifications and variations may suggest themselves to those skilled in the pertinent arts. For example, the fabrication process described herein may be employed with conductive polymer compositions of a wide variety of electrical characteristics, and is thus not limited to those exhibiting PTC behavior. Furthermore, while the present invention is most advantageous in the fabrication of SMT devices, it may be readily adapted to the fabrication of multilayer conductive polymer devices having a wide variety of physical configurations and board mounting arrangements. These and other variations and modifications are considered the equivalents of the corresponding structures or process steps explicitly described herein, and thus are within the scope of the invention as defined in the claims that follow.

What is claimed is:

1. A laminated electronic device, comprising:

first, second, and third PTC layers made of a conductive polymer material;

first and second external metal foil electrodes;

first and second internal metal foil electrodes; and first and second plated metal terminals in direct physical contact with first, second and third PTC layers, the first terminal being in direct physical contact with the first external electrode and the second internal electrode, and the second terminal being in direct physical contact with the first internal electrode and the second external electrode;

wherein a first gap is defined between the first terminal and the first internal electrode, a second gap is defined between the first terminal and the second external electrode, a third gap is defined between the second terminal and the first external electrode, and a fourth gap is defined between the second terminal and the second internal electrode; and wherein the first PTC layer is laminated between the first external electrode and the first internal electrode so as to be in direct contact with the first external electrode and the first internal electrode, the second PTC layer is laminated between the first and second internal electrodes so as to be in direct contact with the first and second internal electrodes, and the third PTC layer is laminated between the second internal electrode and the second external electrode so as to be in direct contact with second internal electrode and the second external electrode; and wherein the first terminal is in electrical contact with the first external electrode and the second internal electrode, and the second terminal is in electrical contact with the first internal electrode and the second external electrode, so that the first, second, and third PTC layers are electrically connected in parallel between the first and second terminals.

2. The electronic device of claim 1, wherein the metal foil of the first and second external electrodes and the first and second internal electrodes is made of a material selected from the group consisting of nickel and nickel-coated copper.

3. The electronic device of claims 1 or 2, wherein each of the first and second terminals comprises first and second metal plating layers, wherein:

the first plating layer is formed of a metal selected from the group consisting of tin, nickel, and copper; and the second plating layer is formed of solder.

4. The electronic device of claims 1 or 2, further comprising:

a first insulating layer on the first external electrode; and a second insulating layer on the second external electrode.

5. The electronic device of claim 4, wherein the insulating layer is made of glass-filled epoxy resin.

6. The electronic device of claim 4, wherein each of the first and second terminals comprises first and second metal plating layers, wherein:

the first plating layer is formed of a metal selected from the group consisting of tin, nickel, and copper; and the second plating layer is formed of solder.

* * * * *